US006033272A

United States Patent [19]

Whiteside

[11] Patent Number: 6,033,272

[45] Date of Patent: Mar. 7, 2000

[54] MARINE JET DRIVE SYSTEM WITH DEBRIS CLEANOUT FEATURE

[75] Inventor: Mark D. Whiteside, Zion, Ill.

[73] Assignee: Outboard Marine Corporation, Waukegan, Ill.

[21] Appl. No.: 09/179,760

[22] Filed: Oct. 27, 1998

[51] Int. Cl.[7] ..... B63H 11/01

[52] U.S. Cl. ..... 440/46; 440/75

[58] Field of Search ..... 440/38, 46, 47, 440/75

[56] References Cited

U.S. PATENT DOCUMENTS

| | | | |
|---|---|---|---|
| 1,888,443 | 11/1932 | Alexander | 440/38 |
| 3,306,046 | 2/1967 | Trapp | 60/222 |
| 3,464,357 | 9/1969 | Duport . | |
| 3,590,766 | 7/1971 | Jackson . | |
| 5,184,967 | 2/1993 | Onoue et al. | 440/75 |

*Primary Examiner*—Stephen Avila
*Attorney, Agent, or Firm*—John H. Pilarski; Dennis M. Flaherty

[57] ABSTRACT

A marine jet propulsion system for a boat or the like comprises a power plant for rotating a drive shaft. A gear system is connected to the drive shaft and is configured to engage and rotate an impeller shaft. An impeller mounted to the impeller shaft is enclosed within a housing having a water inlet opening and a jet stream exit opening. The gear system includes a pinion gear connected to the drive shaft and engaging a pair of opposed ring gears, the ring gears being thus rotatable by the pinion gear in opposite directions. A clutch system is provided for selectively causing the impeller shaft to alternatively be engaged by one or the other of the ring gears and thereby selectively rotating the impeller in opposite directions. By this arrangement, rotation of the impeller in a first direction draws water through the housing in normal fashion to provide thrust at the exit opening, while rotation of the impeller in the opposite direction reverses the flow through the housing causing debris to be flushed out of the impeller or inlet opening. A simple control system allows the boat operator to perform the flushing process while occupying the control station of the boat.

20 Claims, 3 Drawing Sheets

MARINE JET DRIVE SYSTEM WITH DEBRIS CLEANOUT FEATURE

BACKGROUND OF THE INVENTION

1. Field of the Invention

The present invention relates generally to a jet drive system for marine applications and, more particularly, to a marine jet drive system having a novel arrangement for removing debris from the jet drive inlet opening without requiring the operator of the boat in which the system is installed to exit the boat.

2. Description of the Related Art

Jet drive systems of known design for use in marine applications such as jet boats or the like, typically include a power plant comprising an internal combustion engine connected by a drive train to a housed impeller which creates a high pressure stream of water to propel the boat. The inlet to the impeller is usually an opening in the underside of the boat communicating with the impeller. The impeller creates a high pressure water stream discharging to the rear of the boat through a nozzle. Typically, the nozzle is pivotable to allow for steering of the boat. Also, it is known to provide a reverse gate which is selectively operable to cover the exit nozzle and redirect the water stream forwardly of the boat. Thus, the boat can be controlled to move both forward and backward.

In heretofore known marine jet propulsion systems, the drive train of the system has been designed to turn the impeller only in one direction. Moreover, debris such as weeds or other floating objects are often known to enter the impeller housing through the inlet opening and cause clogging of the impeller or inlet opening which is unacceptable to the performance of the boat. When such clogging occurs, the operator of the boat has no means from inside the boat for removing the debris. Accordingly, the boat must be physically removed from the water to expose the jet inlet, or in some cases the operator has the alternative of entering the water and manually removing the debris.

Accordingly, it is desirable to provide a jet drive system for a boat or the like wherein clogging of the impeller or water inlet opening of the drive unit can be alleviated by the boat operator while the operator is simply seated at the controls of the boat. It is further desirable to provide such a system which is readily manufacturable and reliable in use. Still further, it is desirable to provide such a system which can be produced cost effectively and which has perceived value to the ultimate consumer.

SUMMARY OF THE INVENTION

The present invention improves over the prior art by providing a marine jet propulsion system for a boat or the like comprising a power plant for rotating a drive shaft. A gear system is connected to the drive shaft and is configured to engage and rotate an impeller shaft. An impeller mounted to the impeller shaft is enclosed within a housing having a water inlet opening and a jet stream exit opening. The gear system includes a pinion gear connected to the drive shaft and engaging a pair or opposed ring gears, the ring gears being thus rotatable by the pinion gear in opposite directions. A clutch system is provided for selectively causing the impeller shaft to alternatively be engaged by one or the other of the ring gears and thereby selectively rotating the impeller in opposite directions. By this arrangement, rotation of the impeller in a first direction draws water through the housing in normal fashion to provide thrust at the exit opening, while rotation of the impeller in the opposite direction reverses the flow through the housing, causing debris to be flushed out of the impeller or inlet opening. A simple control system allows the boat operator to perform the flushing process while occupying the control station of the boat.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
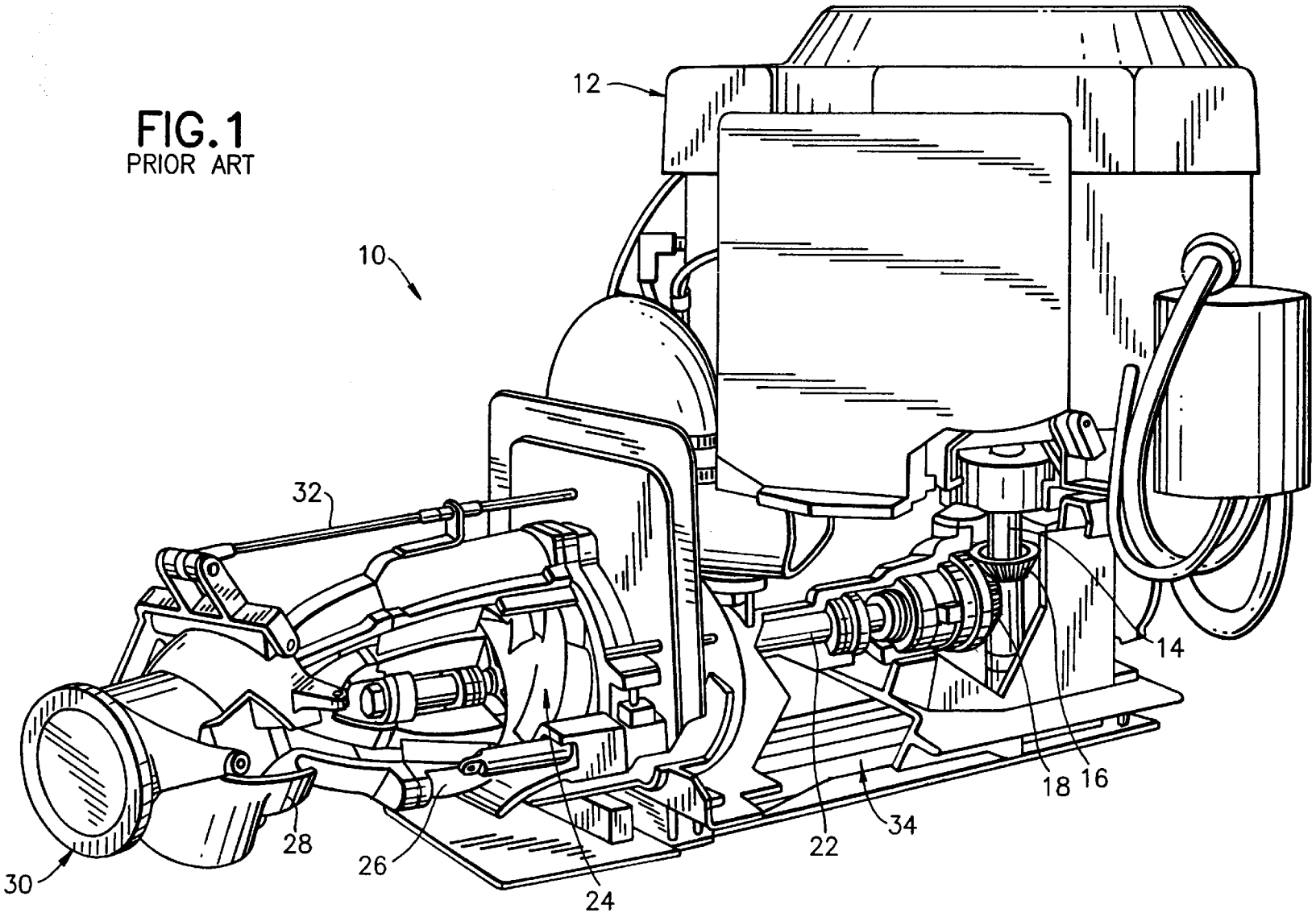
FIG. 1 PRIOR ART
FIG. 1 is a right rear side perspective view of a prior art marine jet propulsion device shown partially broken away.

Referring now to the drawings and initially to FIG. 1, a prior art marine jet propulsion device is designated generally by the reference numeral 10 and includes as a principal assembly a power plant 12 which is characteristically a multi-cylinder internal combustion engine of known design. The power plant 12 drives a drive shaft 14 to which a pinion gear 16 is fixed. The pinion gear 16 in turn engages a ring gear 18 connected to an impeller shaft 22. Fixed to the impeller shaft 22 is an impeller 24 which is journaled for rotation within a housing 26. The housing 26 is provided at its rearward end with a pivotable steering nozzle 28 and with a reverse gate 30 which may be operated by a suitable cable 32. The forward end of the housing 26 is provided with an inlet opening 34 which extends through the underside hull of a boat (not shown). In operation, water is drawn through the inlet opening 34 and is discharged in a high pressure jet stream through the nozzle 28 by the rotating impeller 24. The nozzle 28 may be pivoted by the boat operator to change the direction of the jet stream and thereby steer the boat. Also, the reverse gate may be actuated to reverse the flow direction and consequent thrust of the jet stream and thus shift the boat into reverse. It is noted that in the prior art system only one ring gear and pinion set is provided and, therefore, the impeller is driven in one direction only.

Figure 2:
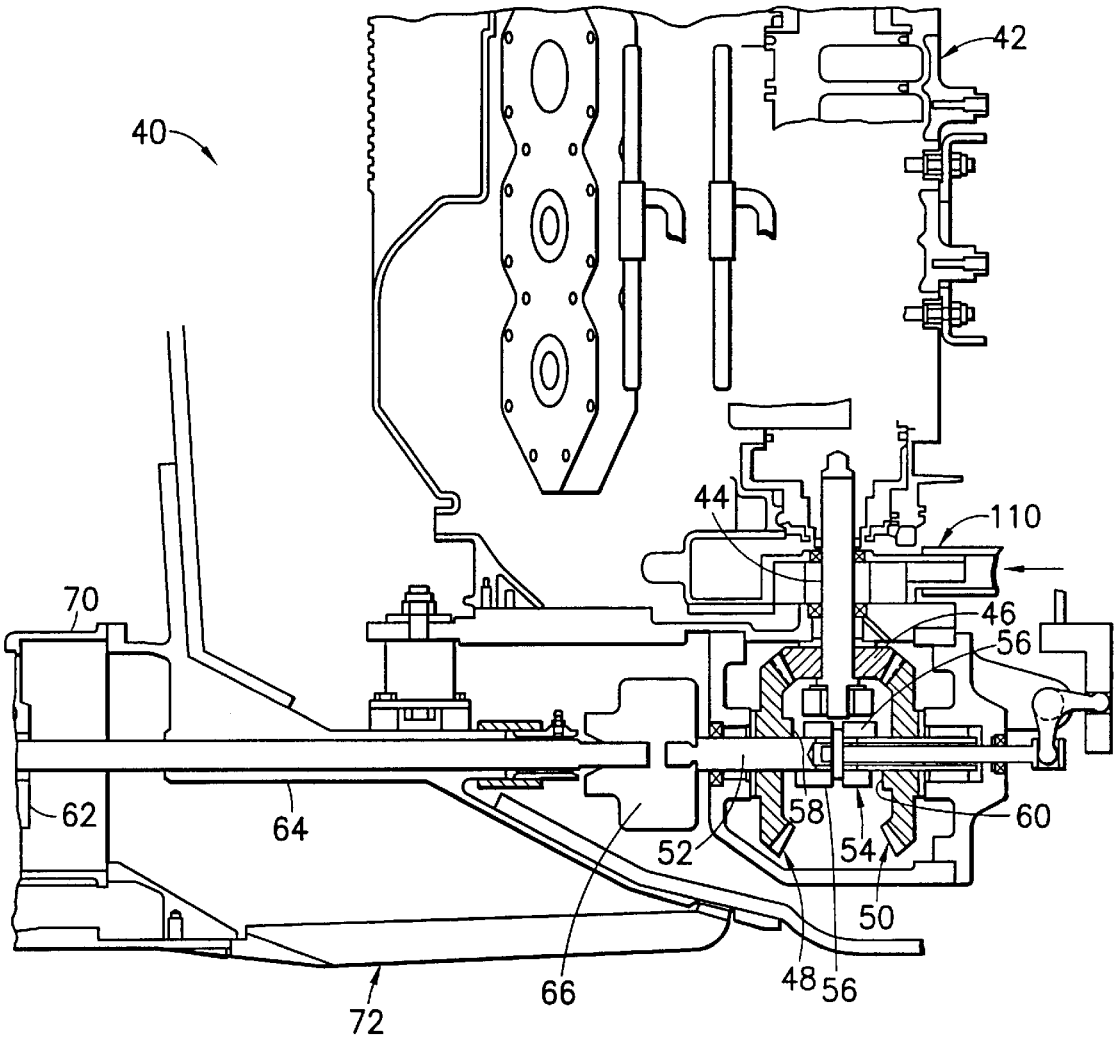
FIG. 2 is a partial side schematic view of a marine jet propulsion device constructed in accordance with the preferred embodiment of the invention.
Figure 3:
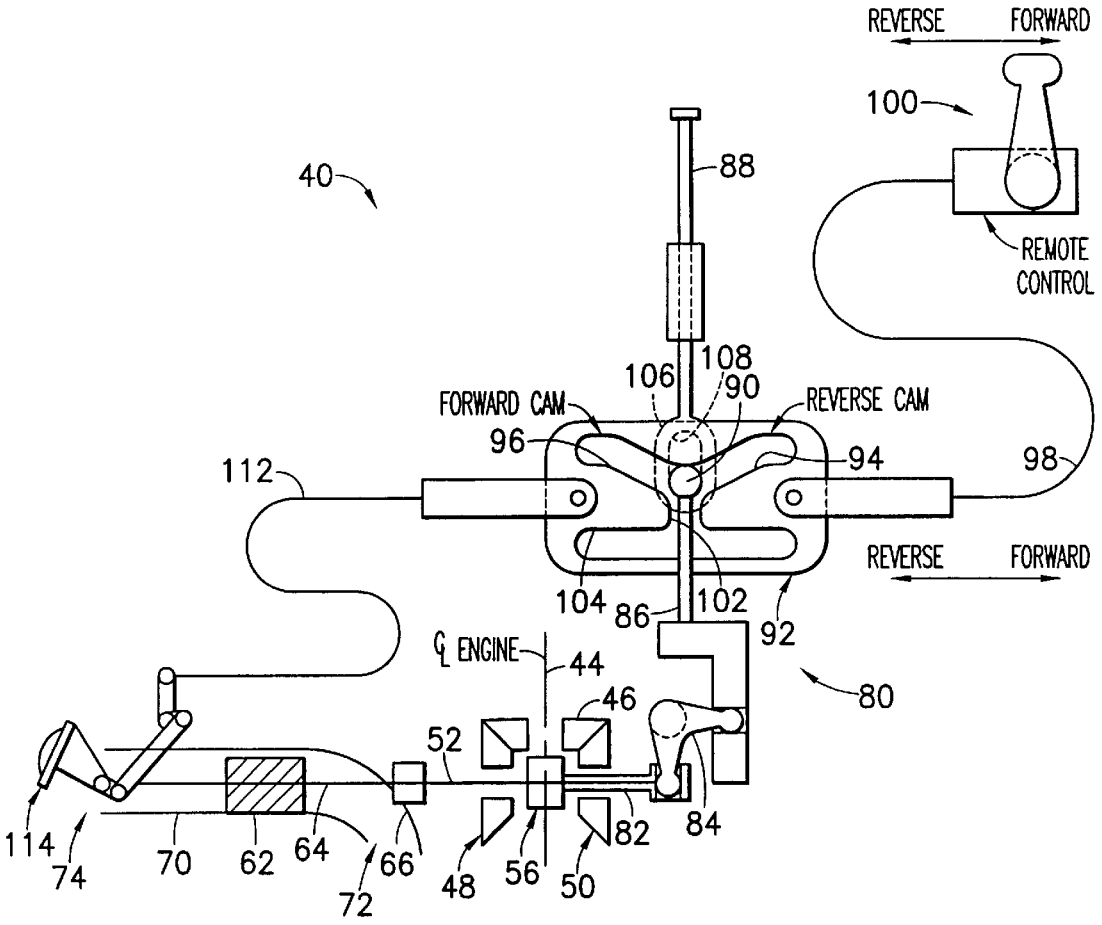
FIG. 3 is a schematic view of a control system for the jet propulsion device illustrated in FIG. 2.

Turning now to FIGS. 2 and 3, a marine jet propulsion system constructed in accordance with the preferred embodiment of the invention is designated generally by the reference numeral 40. The system 40 includes a power plant 42 in the form of an internal combustion engine which drives a drive shaft 44 having a pinion gear 46 fixed to an end thereof The pinion gear 46 in turn engages a pair of ring gears 48 and 50 which are configured to spin freely on a splined impeller shaft 52. A shifter system includes a clutch 54 which is selectively slidable axially of the splined shaft 52 and has suitable lugs 56 for alternatively engaging lugs 58 and 60 of the gears 48 and 50, respectively. An impeller 62 is fixedly mounted to impeller shaft 64 which is connected to shaft 52 by a torque coupling 66.

By virtue of the gear drive arrangement of the system 40, the gears 48 and 50 rotate in opposite directions when driven by the pinion 46. Thus, the clutch 54 may selectively be moved along the splined shaft 52 to alternatively engage one or the other of the gears 48 or 50, causing the shaft 52 and thus the impeller 62 to selectively turn in opposite directions. One advantage of the system 40 is that the impeller 62 may be driven in a normal thrust direction whereby water is drawn into an impeller housing 70 through a conventional inlet opening 72 and is forced as a high pressure jet stream out of an exit opening 74 of the housing 70 by inter-engagement, for example, of the gear 50 and clutch 54. However, when it is desired to clear the inlet opening 72 or impeller 62 of debris, the gear 48 may be engaged by the clutch 54, causing the impeller 62 to counter-rotate, drawing water into the housing 70 through the normal exit opening 74 and forcing it out the inlet opening 72. Thus, the boat operator need not exit the boat to clear a clogging situation, but can simply operate the reverse flushing function from within the boat.

FIG. 3 shows one possible control mechanism 80 for the system 40. In the illustrated example, the mechanism 80 includes a clutch actuator 82 which is moved axially of the shaft 52 by a bellcrank 84. The bellcrank 84 is, in turn, operated by engaging a shaft 86 with a manually operable push rod 88. The shaft 86 is provided at one end with a cam follower 90. A cam plate 92 is configured to be movable from right to left, as viewed in FIG. 3, and includes a cam surface 94 which extends generally upwardly and to the right as well as a cam surface 96 which extends generally upwardly and to the left. The plate 92 is moved by a cable 98 and associated manual control lever assembly 100. The cam plate 92 also includes a first slot 102 disposed generally vertical and leading to a second generally horizontal slot 104. The push rod 88 includes a link portion 106 having a generally vertical slot 108 which captures the cam follower 90.

In operation of the control mechanism 80, and as viewed in FIG. 3, the system 40 is in a neutral condition, as illustrated, with the cam follower 90 aligned with the slot 108 of the cam plate 92. In such a condition, the clutch 54 is centered between and out of engagement with both gears 48 and 50. Thus, the impeller 62 is stationary and the boat is in neutral. In a manner well-known in the art the control lever assembly 100 may be configured to thus idle or rev the boat engine as desired without turning the impeller 62. When it is desired to engage the impeller 62 and move the boat forward, the cam plate 92 is moved to the right, causing the cam surface 96 to engage the cam follower 90 and lift the shaft 86. This action, in turn, rotates the bellcrank 84 counterclockwise, causing the clutch 54 to engage drive gear 50, and thereby rotate the impeller 62 in the normal forward thrust direction. Alternatively, when the cam plate 92 is moved to the left, again as viewed in FIG. 3, the cam surface 94 lifts the cam follower 90 and shaft 86, causing the clutch to engage drive gear 50 and apply normal torque to the impeller 62. However, in this mode the cam plate 92 is connected by a cable 112 to a reverse gate 114 at the exit of the impeller housing 70. The reverse gate 114 is suitably configured to actuate in this mode to thereby reverse the thrust direction of the water jet exiting the housing 70. The boat is, therefore, operable in a reverse direction of movement. It is noted that when the cam plate 92 is moved either to the right or left, the push rod 88 remains stationary as the cam follower 90 moves within the slot 108.

It can be seen from FIG. 3 that when it is desired to reverse direction of the impeller 62 and thus flush the impeller 62 and inlet opening 72 with a reverse stream of water, the push rod 88 is moved downwardly which forces the cam follower down through slot 102 and into slot 104 of the cam plate 92. This action rotates the bellcrank 84 clockwise, causing the clutch to engage gear 48. In this condition, either forward or reverse actuation of the control lever assembly 100 will cause water to flow reversely through the impeller housing 70, thereby flushing the inlet opening 72 of any debris clogged therein. A suitable water pump 110, as illustrated in FIG. 2, may be added to the engine 42 to cool the engine 42 during reverse impeller 62 operation.

It can now be appreciated that the system 40 of the present invention offers considerable advantages over prior art marine jet propulsion systems, particularly in situations whereby a jet boat is operated in water conditions laden with debris. With the present system 40, the boat operator can potentially clear obstructions in the impeller housing or inlet without leaving the driver's seat of the boat. Thus, the boat need not be removed from the water to clear a clog. The system 40 also offers the advantage of allowing the boat propulsion system to have a true neutral, unlike prior art designs wherein the impeller is always turning when the engine is running. Although the present invention has been illustrated with one form of control mechanism 80, it will be appreciated that numerous modifications may be made to this mechanism 80 and still allow the gear system to function acceptably. For example, suitable cables may be used to replace the bellcrank 64 and associated parts. Likewise, a cable arrangement may replace the push rod 88 and related linkage.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A marine jet propulsion system comprising:

a power plant for rotating a drive shaft;

a gear system connected to said drive shaft and configured to engage and rotate an impeller shaft;

an impeller mounted to said impeller shaft;

a housing which surrounds said impeller, said housing having a water inlet opening and a jet stream exit opening;

said gear system including a first gear connected to said drive shaft and in operative engagement with second and third gears, said second and third gears rotating in opposite directions when said first gear rotates in a predetermined direction;

a clutch member for selectively causing said impeller shaft to alternatively be coupled to one of said second and third gears and thereby selectively rotate said impeller in either of opposite directions during rotation of said first gear;

a control system for controlling the state of said clutch member, said control system comprising a clutch actuator and a bellcrank, said bellcrank having a first angular position when said clutch member is in a first state corresponding to said impeller shaft being coupled to said second gear and having a second angular position when said clutch member is in a second state corresponding to said impeller shaft being coupled to said third gear, whereby rotation of said impeller in a first direction draws water through said housing exit opening and causes debris to be flushed out of said inlet opening.

2. A marine jet propulsion system comprising:

a power plant for rotating a drive shaft;

a gear system connected to said drive shaft and configured to engage and rotate an impeller shaft;

an impeller mounted to said impeller shaft;

a housing which surrounds said impeller, said housing having a water inlet opening and a let stream exit opening;

said gear system including a first gear connected to said drive shaft and in operative engagement with second and third gears, said second and third gears rotating in opposite directions when said first gear rotates in a predetermined direction;

a clutch member for selectively causing said impeller shaft to alternatively be coupled to one of said second and third gears and thereby selectively rotate said impeller in either of opposite directions during rotation of said first gear; and a control system for selectively moving said clutch member and comprising a cam plate which is selectively movable in opposite directions and a cam follower which engages said cam plate and is mechanically coupled to said clutch member.

3. The marine jet propulsion system of claim 2 wherein said cam plate comprises a first cam surface disposed such that movement of said cam plate in a first direction causes said cam follower to actuate movement of said clutch member in a first direction.

4. The marine jet propulsion system of claim 3 wherein said cam plate comprises a second cam surface disposed such that movement of said cam plate in a second direction causes said cam follower to actuate movement of said clutch member in said first direction.

5. The marine jet propulsion system of claim 3 wherein movement of said clutch member in said first direction causes said clutch member to engage said second gear and to rotate said impeller in a first direction.

6. The marine jet propulsion system of claim 5 wherein said first direction of rotation of said impeller is a direction whereby water is drawn into the inlet opening of said housing and is discharged through the exit opening of said housing.

7. The marine jet propulsion system of claim 4 wherein said cam plate comprises a first slot leading from said first and second cam surfaces to a second slot in said cam plate, said second slot being formed generally at right angles to said first slot.

8. The marine jet propulsion system of claim 7, further comprising means for moving said cam follower along said first slot and into said second slot.

9. The marine jet propulsion system of claim 8 wherein movement of said cam follower into said second slot causes said clutch member to move in a second direction opposite said first direction.

10. The marine jet propulsion system of claim 9 wherein movement of said clutch member in said second direction causes said clutch member to engage said third gear and to rotate said impeller in a second direction.

11. The marine jet propulsion system of claim 10 wherein said second direction of rotation of said impeller is a direction whereby water is drawn into the exit opening of said housing and is discharged through the inlet opening of said housing.

12. The marine jet propulsion system of claim 2 wherein said cam plate is operatively connected to a selector control for movement of said cam plate by an operator.

13. The marine jet propulsion system of claim 3 further comprising a reverse gate disposed at said exit opening and operatively coupled to said cam plate such that movement of said cam plate in said first direction actuates said reverse gate to reverse the flow of water discharged from said exit opening.

14. A marine jet propulsion system comprising:

a drive shaft;

a power plant for rotating said drive shaft in a predetermined direction;

an impeller shaft;

an impeller mounted on said impeller shaft;

a clutch member selectively movable from a neutral clutch state into either a first or a second clutch state;

a system for coupling said impeller shaft to rotate in a first direction when said drive shaft rotates in said predetermined direction and said clutch member is in said first clutch state, and in a second direction opposite to said first direction when said drive shaft rotates in said predetermined direction and said clutch member is in said second clutch state;

a control system for selectively moving said clutch member, said control system comprising a cam plate which is selectively movable in opposite directions and comprising an array of communicating slots and an axially movable shaft having a cam follower at one end which is captured in said slot array.

15. The marine jet propulsion system of claim 14 wherein said control system further comprises an axially movable push rod having a link portion with a slot which captures said cam follower.

16. The marine jet propulsion system of claim 14 wherein said control system further comprises a bellcrank coupled to said shaft such that said bellcrank rotates from a first angular position corresponding to said neutral clutch state to a second angular position corresponding to said first clutch state in response to said shaft moving from a first axial position to a second axial position.

17. The marine jet propulsion system of claim 16 wherein said shaft does not move axially as said push rod moves from a first axial position to a second axial position, but said shaft moves from said first axial position to said second axial position as said push rod moves from said second axial position to a third axial position, said second axial position of said push rod being between said first and third axial positions of said push rod.

18. The marine jet propulsion system of claim 17 wherein said slot array is configured such that said shaft moves from said first axial position to a third axial position when said cam plate moves in either a first direction or in a second direction opposite to said first direction, said first axial position of said shaft being between said second and third axial positions of said shaft, and said bellcrank rotating from said first angular position corresponding to said neutral clutch state to a third angular position corresponding to said second clutch state in response to said shaft moving from said first axial position to said third axial position.

19. The marine jet propulsion system of claim 18 further comprising a reverse gate disposed at said exit opening and operatively coupled to said cam plate such that movement of said cam plate in said first direction actuates said reverse gate to reverse the flow of water discharged from said exit opening.

20. A marine jet propulsion system comprising:

a drive shaft;

a power plant for rotating said drive shaft in a predetermined direction;

an impeller shaft;

an impeller mounted on said impeller shaft;

a clutch member selectively movable between first and second clutch states;

a system for uncoupling said impeller shaft from said drive shaft when said clutch member is in said first clutch state and coupling said impeller shaft to rotate during rotation of said drive shaft in said predetermined direction when said clutch member is in said second clutch state;

a control system for selectively moving said clutch member, said control system comprising an axially movable shaft having a projection at one end and an axially movable push rod having a link portion with a slot which captures said projection, said push rod being movable from a first axial position to a second axial position to a third axial position in sequence, said second axial position of said push rod being between said first and third axial positions of said push rod, wherein said shaft remains in a first axial position of said shaft corresponding to said first clutch state as said push rod moves from said first axial position to said second axial position of said push rod, and said shaft moves from said first axial position to a second axial position of said shaft corresponding to said second clutch state as said push rod moves from said second axial position to said third axial position of said push rod.

* * * * *

UNITED STATES PATENT AND TRADEMARK OFFICE

CERTIFICATE OF CORRRECTION

PATENT NO. : 6,033,272
DATED : 3/7/2000
INVENTOR(S) : WHITESIDE

It is certified that error appears in the above-identified patent and that said Letters Patent is hereby corrected as shown below:

On the Title page, item [56] U.S. Patent Document:
Insert --

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 2 | 4 | 9 | 0 | 8 | 3 | 5/3/66 | Irgens | 115 | 12 | |
| | | | | | | | | | | | | | |
| | | | | | | | | | | | | | |
| | | | | | | | | | | | | | |

--.

Signed and Sealed this

Eighth Day of August, 2000

*Attest:*

Q. TODD DICKINSON

*Attesting Officer*

*Director of Patents and Trademarks*